United States Patent [19]

Marushima et al.

[11] 4,298,669

[45] Nov. 3, 1981

[54] ELECTROPHOTOGRAPHIC PROCESS AND APPARATUS

[75] Inventors: Giichi Marushima; Hiroshi Tanaka; Umi Tosaka, all of Tokyo; Shinkichi Takahashi, Yokohama; Takao Komiyu, Tokyo, all of Japan

[73] Assignee: Canon Kabushiki Kaisha, Tokyo, Japan

[21] Appl. No.: 63,431

[22] Filed: Aug. 3, 1979

Related U.S. Application Data

[60] Continuation of Ser. No. 298,010, Oct. 16, 1972, abandoned, which is a division of Ser. No. 133,788, Apr. 14, 1971, Pat. No. 3,734,609, which is a division of Ser. No. 563,899, Jul. 8, 1966, Pat. No. 4,071,361.

[30] Foreign Application Priority Data

Feb. 23, 1966 [JP] Japan ..... 41-10915

[51] Int. Cl.[3] ..... G03G 13/24; G03G 13/04

[52] U.S. Cl. ..... 430/55; 430/31; 355/3 R; 355/8

[58] Field of Search ..... 430/31, 55

[56] References Cited

U.S. PATENT DOCUMENTS

| | | | |
|---|---|---|---|
| 3,182,573 | 5/1965 | Clark et al. | 430/31 |
| 3,272,626 | 9/1966 | Shinn | 430/31 |
| 3,457,070 | 7/1969 | Watanabe et al. | 430/55 X |
| 3,536,483 | 10/1970 | Watanabe et al. | 430/55 |
| 4,071,361 | 1/1978 | Marushima | 430/55 |

*Primary Examiner*—Roland E. Martin, Jr.
*Attorney, Agent, or Firm*—Fitzpatrick, Cella, Harper & Scinto

[57] ABSTRACT

A process and apparatus for forming an electrostatic image on a photosensitive plate having a conductive base, a photoconductive layer overlying the base and exhibiting p-type or n-type semiconductivity, and an insulative layer overlying the photoconductive layer. The photosensitive plate is characterized in having carrier charge of a polarity corresponding to the conductivity type of the photoconductive layer injectable from the conductive base into the photoconductive layer and bound in the region of the interface between the insulative and photoconductive layers. The conductive base is transparent to activating light and the insulative layer is opaque to the activating light. A first charge of a polarity opposite to the conductivity type of the photoconductive layer is applied onto the insulative layer to inject and bind carrier charge in the region of the interface between the insulative and photoconductive layers. Then, the photoconductive layer is exposed to a pattern of activating image light by projecting the image light through the transparent conductive base while a corona discharge is applied onto the insulative layer. Thereafter, the photoconductive layer is exposed to activating light through the transparent conductive base to discharge bound carrier charge remaining in the region of the interface and form a high constrast electrostatic image.

3 Claims, 7 Drawing Figures

ELECTROPHOTOGRAPHIC PROCESS AND APPARATUS

This is a continuation of Application Ser. No. 298,010, filed Oct. 16, 1972, now abandoned, which in turn is a division of application Ser. No. 133,788, filed Apr. 14, 1971, now U.S. Pat. No. 3,734,609, issued May 22, 1973, which in turn is a division of application Ser. No. 563,899, filed July 8, 1966, now U.S. Pat. No. 4,071,361, issued Jan. 31, 1978.

This invention relates to an electrographic process and apparatus, and more particularly to process and apparatus for forming electrostatic images.

In copending and commonly assigned United States patent application Ser. No. 563,899, filed July 8, 1966, an electrostatic image is formed on a photosensitive plate having a conductive base, a photoconductive layer overlying the base and exhibiting p-type or n-type semiconductivity and an insulative layer overlying the photoconductive layer. The photosensitive plate is characterized in having carrier charge of a polarity corresponding to the conductivity type of the photoconductive layer injectable from the conductive base into the photoconductive layer and bound in the region of the interface between the insulative and photoconductive layers. The electrostatic image is formed by first applying a first charge of a polarity opposite to the conductivity type of the photoconductive layer substantially uniformly onto the insulative layer to inject and bind carrier charge in the region of the interface between the insulative and photoconductive layers. Then the photoconductive layer is exposed to a pattern of image light, while a corona discharge of a polarity opposite to that of the first charge is applied onto the insulative layer. Thereafter the photoconductive layer is exposed to activating light to discharge bound carrier charge remaining in the region of the interface and form a high contrast electrostatic image.

An object of the present invention is to provide a process and apparatus for producing an electrostatic image in accordance with the electrostatic method of said copending application Ser. No. 563,899 wherein the insulating layer is non-transparent and wherein the conductive base is made of a translucent substance; and to provide a process and apparatus for forming an electrostatic image of the original image on the insulating layer by irradiating the original image from the translucent base side and simultaneously applying corona discharge on the insulating layer.

Figure 6:
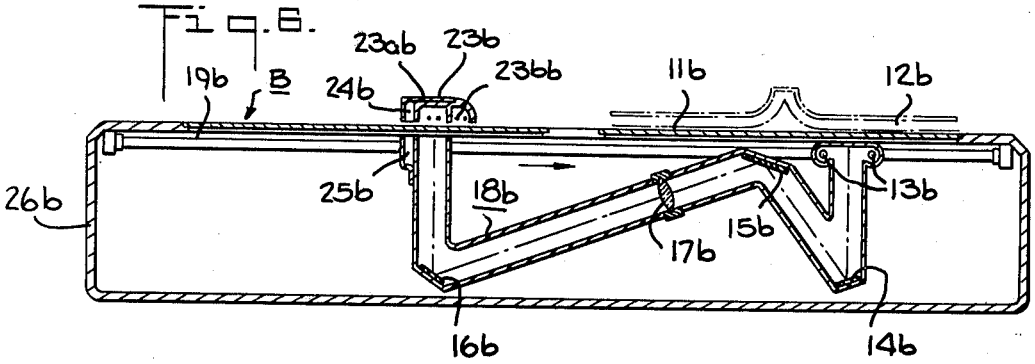
Figure 7:
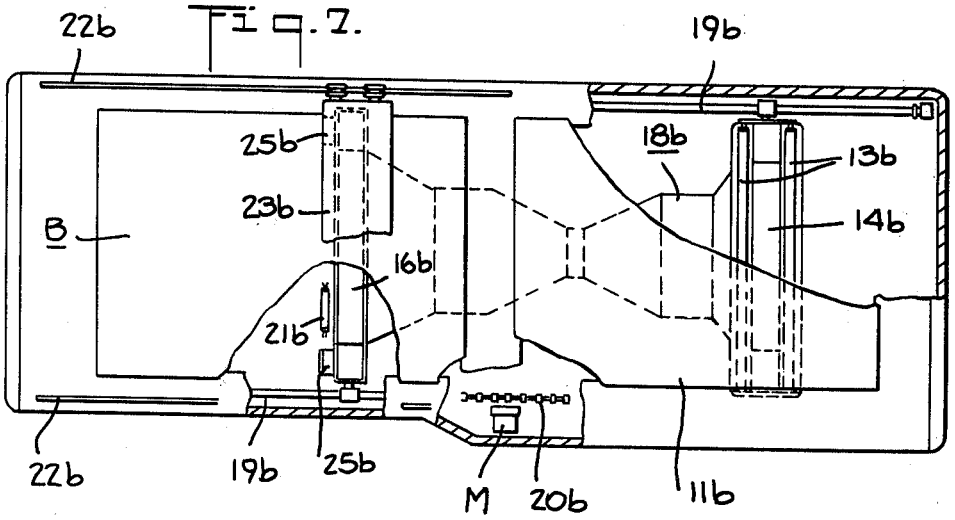

The above object and various other objects and the advantages of the present invention will become clear from the following detailed description, taken in conjunction with the accompanying drawings, in which:

FIGS. 1 to 5 schematically show the stages of making electrostatic images according to the present invention; and FIGS. 6 and 7 show an embodiment of the electrophotographic device where the present invention is applied.

Figure 1:
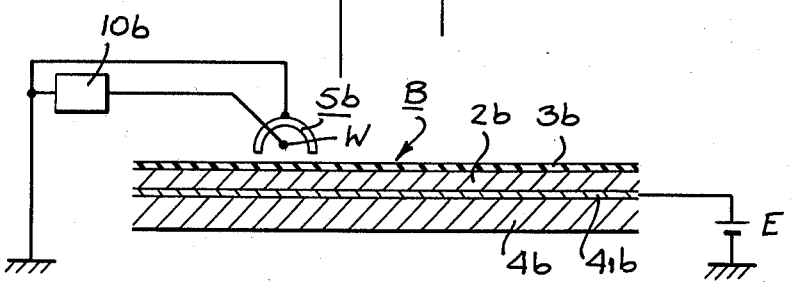

In FIG. 1, B is a photosensitive plate, comprising an overlaying photoconductive layer **2*b* and insulating layer 3*b*. 4*b* is a transparent support for photosensitive plate B, and on one surface thereof, conductive coating is disposed to form the electrode 41*b***.

The photosensitive plate B is characterized in having carrier charge of a polarity corresponding to the conductivity type of the photoconductive layer **2*b* injectable from the electrode 41*b* into the photoconductive layer 2*b* and bound in the region of the interface between the insulating layer 3*b* and photoconductive layer 2*b***.

The photoconductive layer **2*b*** can be prepared using conventional semiconductor materials which have photoconductivity, such as Se, ZnO, CdS and the like, dispersed in a dispersing agent, and coated on the conductive base by means of coating or vacuum evaporation, sublimation, melting or the like.

The insulating layer **3*b* used depends on the spectral sensitivity of the photoconductive material forming the photoconductive layer 2*b***. For example, where the photoconductive layer has a sensitivity to visible rays, Mylar (a polyester terephthalate film manufactured by DuPont) colored black is used or a filter is provided.

The process for making the image is explained hereinafter in accordance with FIG. 1 through FIG. 5. Photosensitive plate B is overlaid on support **4*b*, and a primary charge is made by charging device 5*b* from the side of insulating layer 3*b*** (either corona discharge or the electrode contact method can be employed).

As to the charge polarity in this case, it is preferable that where the photoconductive layer **2*b*** is an n-type semiconductor, that it be positive; and where it is a p-type semiconductor, that it be negative. The residual charge of the prior electrostatic latent image, is erased by the primary charge, and at the same time the contrast of the electrostatic latent image is greatly improved.

Figure 2:
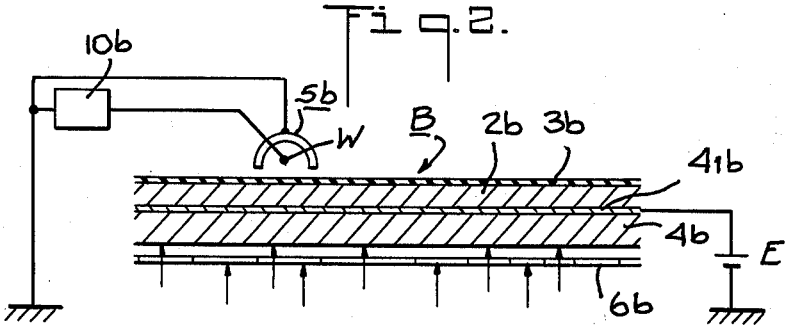
Figure 3:
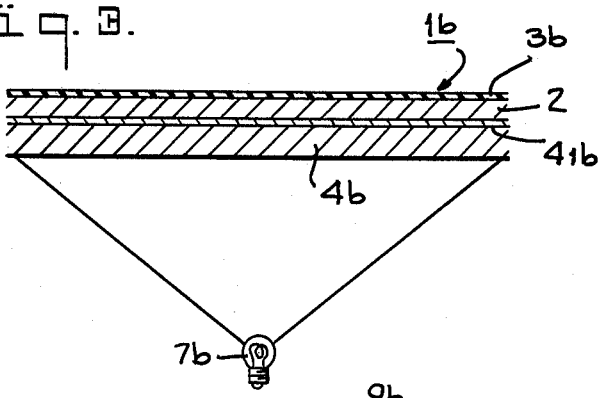
Figure 4:
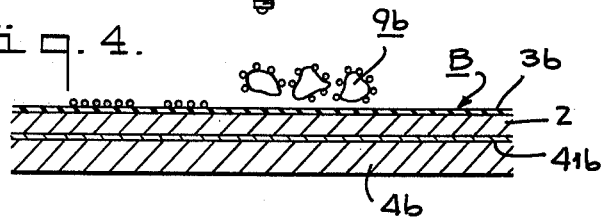
Figure 5:
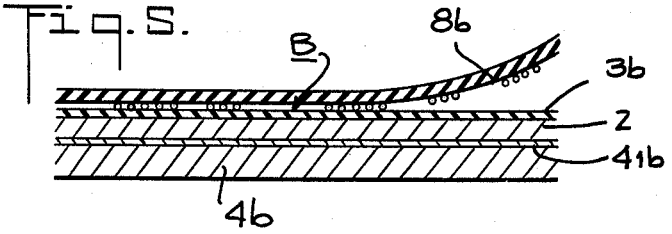

Then, as shown in FIG. 2, a secondary charge of opposite polarity to the primary charge is made while projecting the original copy **6*b* from the side of the photoconductive layer 2*b* of the photosensitive plate B, and thereafter overall radiation is made with lamp 7*b* to form the electrostatic latent image on the insulating layer 3*b* (FIG. 3**).

Thereafter, in accordance with conventional methods, the image is visualized on the surface of the insulating layer, and the resulting image is transferred onto the transferring material **8*b*, and the photosensitive plate B is cleaned, and reused. The image transferred onto the transferring material 8*b* is fixed and used as an ordinary copy (FIG. 5). 9*b* is the developer, and 10*b* is the means for generating high voltage, and 10*b* is connected to the corona generating coil W, while high voltage E is applied to the side of transparent electrode 4*b***.

FIGS. 6 and 7 show an embodiment of an electrophotographic device wherein the present invention is employed. The image of the original copy **12*b* placed on the glass 11*b* is illuminated by the lamp 13*b*, and projected onto the photosensitive plate B as a positive image by means of the reflecting optical system 18*b* which contains the reflecting mirrors 14*b*, 15*b*, 16*b* and lens 17*b*. The reflecting optical system 18*b* is moved to the right and left at a constant speed by the reversible motor M, and chain 20*b* along the rail 19*b*, and projects the whole length of the image of the original copy 12*b* on the photosensitive plate B in turn. Lamp 21*b* provides overall exposure at the reflecting optical system 18*b***.

Charger **23*b* comprises corona discharging portions 23*ab* and 23*bb* for primary and secondary charges, and is made so as to move to the right and left on the two rails 22*b* provided on the frame 26*b* parallel with the photosensitive plate B. Magnet 24*b* is provided on charger 23*b*, and the attraction of the magnet 25*b* attached to the reflecting optical system 18*b* to magnet 24*b*, moves charger 23*b*** in the same direction as the optical system 18*b*, in accordance with the movement of the optical system 18*b*.

An electrostatic latent image is formed on the photosensitive plate B similar to the image of the original copy 12*b* by means of a single scanning of the reflecting optical system 18*b* in the direction as shown by an arrow in FIG. 6. The respective operations of developing the image, transferring the developed image, and cleaning are done elsewhere.

In accordance with the present invention, the insulating layer of the photosensitive plate obtained by overlaying the insulating layer on the surface of photoconductive layer, as mentioned above, is made sufficiently opaque so as to not allow any light to penetrate which is within the photosensitive wave length region of photoconductive layer, and therefore the whole process of making an image can be done in a lighted area.

It is apparent that the present invention can be modified by the expert in the art within the scope of the disclosure herein and the following claims.

What is claimed is:

1. A process for forming an electrostatic image of an original on a photosensitive plate having a conductive base, a photoconductive layer overlying said base and exhibiting p-type or n-type semi-conductivity and an insulative layer overlying said photoconducting layer, said conductive base being transparent to activating light for said photoconductive layer and said insulative layer being opaque to said activating light, said photosensitive plate being characterized in having carrier charge of a polarity corresponding to the conductivity type of said photoconductive layer injectable from said conductive base into said photoconductive layer and bound in the region of the interface between said insulative and photoconductive layers, said process comprising the steps of:

(a) applying a first charge of a polarity opposite to the conductivity type of said photoconductive layer substantially uniformly onto said insulative layer by moving a primary corona discharging means over said insulative layer to inject and bind carrier charge in the region of the interface between said insulative and photoconductive layers;

(b) then exposing said photoconductive layer to a pattern of activating image light by scanning an optical system over the original and projecting original image light through said conductive base while applying a corona discharge onto said insulative layer which results in the application of charge of a polarity opposite to that of the initial charge by moving a secondary corona discharging means over said insulative layer, said optical system and said secondary corona discharging means being aligned with respect to the photosensitive plate so as to facilitate their simultaneous operation; and then (c) exposing said photoconductive layer to activating light by projecting activating light generated from an overall exposure means through said transparent conductive base to discharge bound carrier charge remaining in the region of said interface and form a high contrast electrostatic image.

2. A process according to claim 1, further comprising the steps of:

(d) visualizing said electrostatic image by applying a developer onto said insulative layer, (e) transferring said visualized image onto a transfer sheet and fixing the thus visualized image, and (f) cleaning the surface of said insulative layer of said photosensitive plate to remove residual developer and enable the repetitive use of said photosensitive plate.

3. A process for forming an electrostatic image of an original on a photosensitive plate having a conductive base, a photoconductive layer overlying said base and an insulating layer overlying said photoconductive layer, said conductive base being transparent to activating light for said photoconductive layer and said insulating layer being opaque to said activating light, said process comprising the steps of:

(a) applying a first charge substantially uniformly onto said insulating layer by moving a primary corona discharging means over said insulative layer;

(b) then exposing said photoconductive layer to a pattern of activating image light by scanning an optical system over the original and projecting original image light through said conductive base, while applying a second charge onto said insulating layer which results in the application of charge of a polarity opposite to that of the initial charge by moving a secondary corona discharging means over said insulative layer, said optical system and said secondary corona discharging means being aligned with respect to the photosensitive plate so as to facilitate their simultaneous operation; and then (c) uniformly exposed said photoconductive layer to activating light to which said photoconductive layer is sensitive by projecting said activating light from an overall exposure means through said transparent conductive base.

* * * * *

UNITED STATES PATENT OFFICE

CERTIFICATE OF CORRECTION

Patent No. 4,298,669 Dated November 3, 1981

Inventor(s) HIROSHI TANAKA, ET AL.

It is certified that error appears in the above-identified patent and that said Letters Patent are hereby corrected as shown below:

On the title page:

Under "United States Patent [19]", "Marushima et al." should read --Tanaka et al.--.

Paragraph [75] should read:

--Inventors: Hiroshi Tanaka, Tokyo; Shinkichi Takahashi, Yokohama, both of Japan--

Signed and Sealed this

Sixth Day of April 1982

[SEAL]

Attest:

GERALD J. MOSSINGHOFF

Attesting Officer

Commissioner of Patents and Trademarks